US005365314A

United States Patent [19]

Okuda et al.

[11] Patent Number: 5,365,314

[45] Date of Patent: Nov. 15, 1994

[54] IMAGE HEATING APPARATUS CAPABLE OF CHANGING DUTY RATIO

[75] Inventors: Kouichi Okuda; Shunji Nakamura; Yasumasa Ohtsuka, all of Yokohama; Yohji Tomoyuki, Ichikawa; Akira Hayakawa; Daizo Fukuzawa, both of Tokyo, all of Japan

[73] Assignee: Canon Kabushiki Kaisha, Tokyo, Japan

[21] Appl. No.: 38,881

[22] Filed: Mar. 29, 1993

[30] Foreign Application Priority Data

Mar. 27, 1992 [JP] Japan ..... 4-101604

[51] Int. Cl.[5] ..... G03G 15/20

[52] U.S. Cl. ..... 355/208; 335/285; 219/216; 219/497

[58] Field of Search ..... 355/285, 208; 219/216, 219/494, 482, 497, 501; 323/245

[56] References Cited

U.S. PATENT DOCUMENTS 4,496,829 1/1985 Black et al. ..... 219/497

5,149,941 9/1992 Hirabayashi et al. ..... 219/216

*Primary Examiner*—Joan H. Pendegrass

*Attorney, Agent, or Firm*—Fitzpatrick, Cella, Harper & Scinto

[57] ABSTRACT

An image heating apparatus includes a heater; a temperature detecting member for detecting a temperature of the heater; the controller for controlling electric power supplied to the heater so that the temperature detected by the temperature detecting member is maintained at a predetermined temperature; comparing device for comparing the temperature detected by the temperature detecting member to the reference temperature; wherein, when the detected temperature remains to be no less than the reference temperature for a predetermined period of time, the controller reduces a duty ratio of the electric power to be supplied to the heater.

16 Claims, 7 Drawing Sheets

IMAGE HEATING APPARATUS CAPABLE OF CHANGING DUTY RATIO

FIELD OF THE INVENTION AND RELATED ART

The present invention relates to an image heating apparatus for heating an image on recording material, with use of heat from a heater controlled to maintain a specific predetermined temperature, in particular, an image heating apparatus suitable for thermally fixing an unfixed image.

As the image heating apparatus for heating the image on the recording material, those using a combination of a low thermal capacity heater with quick response and a thin film which slides in contact with the surface of this heater have been proposed in U.S. Pat. Nos. 206,767, and 444,802. If electric power is turned on and off to stabilize the temperature of this extremely low thermal capacity heater, temperature ripple increases.

Therefore, in U.S. application No. 07/450,560, it is proposed to stabilize the temperature by varying, corresponding to the heater temperature, the energy supplied through electric power application.

An example is shown in Table 1, in which the energy supplied through the electric power application is varied corresponding to the heater temperature.

The target temperature is 180° C.

TABLE 1

| Temperature - Power | | |
|---|---|---|
| Heater Temp. (°C.) | Power (W) (Nominal) | Ratio |
| 200– | 0 | 0/10 |
| 190–200 | 150 | 3/10 |
| 180–190 | 200 | 4/10 |
| 170–180 | 250 | 5/10 |
| 160–170 | 300 | 6/10 |
| 150–160 | 350 | 7/10 |
| –50 | 500 | 10/10 |

FIG. 7 shows the results of the temperature control executed using this temperature-electric power table. In period A in which the first paper to the tenth paper are fed, since the majority of the heat generated by the heater 2 is robbed by a pressure roller and a stay which supports the heater, the heater temperature becomes approximately 160° C., and the electric power applied to the heater alternates between 300 W and 350 W. As the pressure roller and stay warm up, the heater temperature gradually increases to 170° C. after the 10th paper (in period B), to 180° C. after the 20th paper (period C), and to approximately 190° C. after the 40th paper (period D), wherein the electric power applied to the heater alternates between 200 W and 150 W.

According to FIG. 3, the electric power necessary for maintaining the heater temperature at a target value of 180° C. is:

no less than 400 W in period E,
between 350 W and 400 in period F,
between 300 W and 350 W in period G,
between 250 W and 300 W in period H,
between 200 W and 250 W in period I,
between 150 W and 200 W in period J, and
no more than 150 W in period K.

However, according to Table 1, the electric power alternates between 200 W and 250 W when the heater temperature is around 180° C., and therefore, the heater temperature cannot be maintained at the target temperature of 180° C. except in period I.

In other words, if Table 1 is used as the temperature-electric power table, the heater temperature becomes:

160° C. to 170° C. through the application of no less than 300 W in period A,

170° C. to 180° C. through the application of 250 W to 300 W in period B,

180° C. to 190° C. through application of 200 W to 250 W in period C, and no less than 190° C. through application of 150 W to 200 W in period D.

In other words, in comparison to the target temperature of 180° C., the heater temperature changes by as much as 30° C., from 160° C. at immediately after the feeding of the first paper to 190° C. after the feeding of 50th paper. Therefore, there are going to be problems in that fixing failure occurs immediately after the feeding of the initial paper, and that the high temperature offset occurs around the 50th paper.

If 350 W is applied when the heater temperature is no more than 180° C., and 150 W is applied when it is no less than 180° C., in order to prevent this temperature drift, then the average heater temperature becomes approximately 180° C., but the temperature ripple becomes extremely large.

Further, if the power source voltage varies, for example, if it drops from 100 V to 80 V, the electric power to be applied is reduced compared to the reference electric power, and therefore, there is a problem in that the heater temperature drops below the target temperature.

It is also possible to provide a power source voltage detecting means for compensating for the output electric power in response to the power source voltage fluctuation. However, this makes the control circuit complicated.

SUMMARY OF THE INVENTION

The object of the present invention is to provide an image heating apparatus capable of stabilizing the heater temperature regardless of the apparatus temperature.

Another object of the present invention is to provide an image heating apparatus capable of stabilizing the heater temperature even if the power source voltage fluctuates.

According to an aspect of the present invention, there is provided an image heating apparatus comprising a heater, a temperature detecting member for detecting the temperature of said heater, controlling means for controlling the electric power to be applied to said heat so that the temperature detected by said temperature detecting member can be maintained at a specific predetermined temperature, and comparing means for comparing the temperature detected by said temperature detecting member to the reference temperature, wherein said controlling means reduces the duty ratio of the electric power to be applied if the temperature detected by said temperature detecting member exceeds the reference temperature for a predetermined period of time, and/or increases the duty ratio of the electric power to be applied if the temperature detected by said temperature detecting member remains below the reference temperature for a predetermined period of time.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
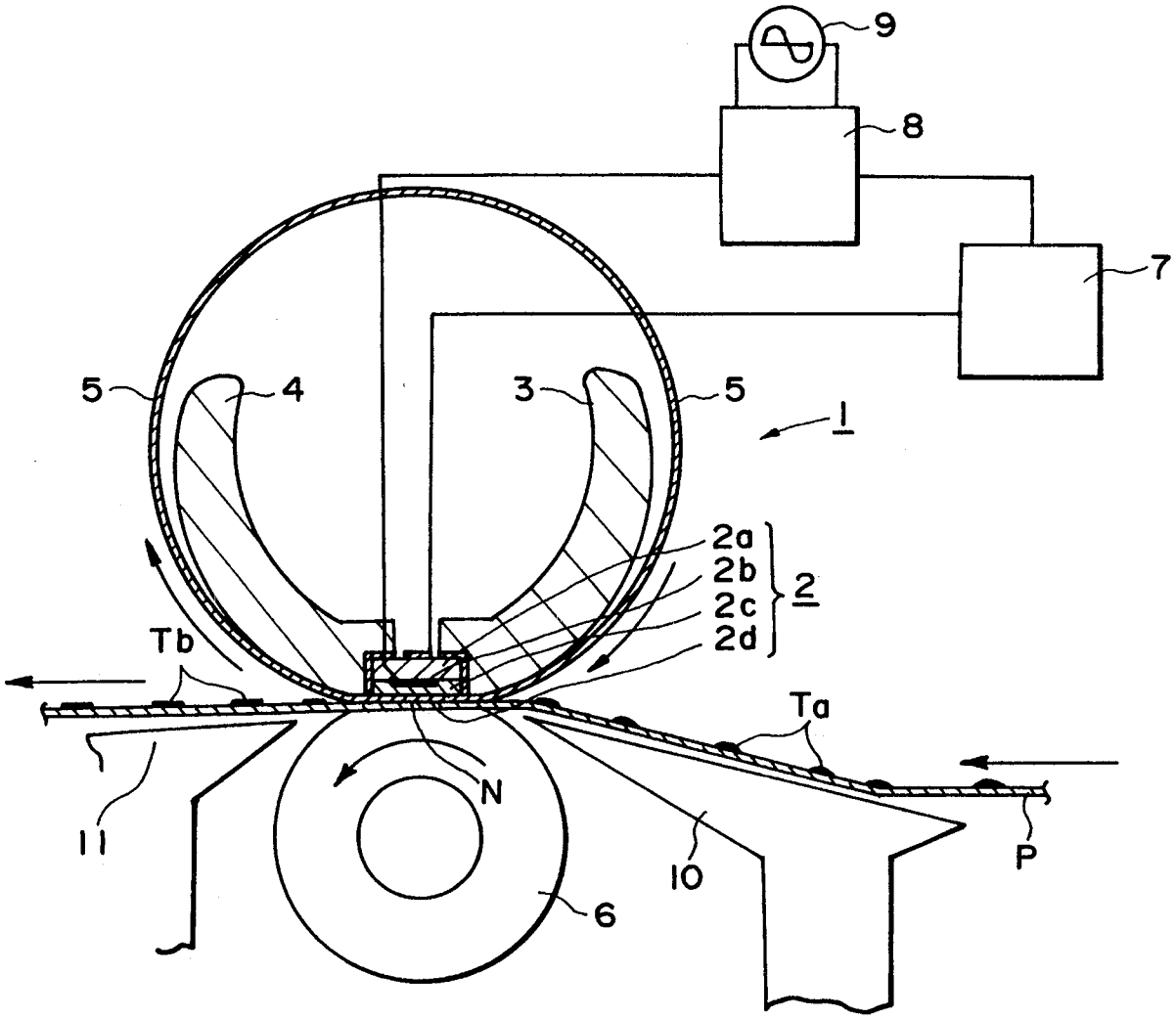
FIG. 1 is a sectional view of an image heating apparatus in accordance with an embodiment of the present invention.

FIG. 1 is a sectional view of an image heating apparatus in accordance with an embodiment of the present invention.

Reference numeral 2 designates a heating member (hereinafter, referred to as heater), the longitudinal direction of which is perpendicular to the direction in which the recording material P is conveyed. Reference numerals 3, 4 designate thermally insulating stays which also work as a film guide. They have an arc-shaped cross section and are substantially symmetrically arranged on the left and right sides of the heater 2 as shown in the drawing. Reference numeral 5 designates a heat resistant endless film (fixing film) engaged loosely and externally with the stays 3, 4, and the heater 2. As to the relation between the internal peripheral length of this heat resistant endless film 5 and the combined external peripheral length of the stays 3, 4 and the heater 2, the film 5 is longer, for example, by 3 mm or so. Therefore, the film 5 holds loose, external contact with the stays 3, 4 and heater 2, with an ample peripheral margin.

The stays 3, 4 are fixedly supported on an unshown stationary member, and the heater 2 is fixedly supported by the stays 3, 4.

Reference numeral 6 designates a film driving roller which sandwiches the above mentioned film 5 in a manner so as to press the film 5 against the bottom surface of the heater 2.

As the pressure roller 6 is rotatively driven in the counterclockwise direction as shown by an arrow, the endless film 5 is rotatively driven by the frictional force in the clockwise direction shown by another arrow, and slides at a predetermined peripheral speed (process speed) on the bottom surface of the heater 2 while remaining tightly in contact with the surface.

The heater 2 in this embodiment is a linear heating member of low thermal capacity comprising: a substrate 2*a*, which is insulating, highly heat resistant, and of low thermal capacity; a resistance heating layer 2*b* formed on the surface of this substrate along its longitudinal direction; a surface protective layer 2*c* of glass, fluorocarbon resin, or the like, which is formed on the resistance heating layer 2*b*; a thermistor 2*d* as heater temperature detecting means provided in contact with the substrate surface opposite to the one where the surface protective layer 2*c* is formed; and the like.

The heater 2 is placed between the stays 3, 4, with its surface protective layer 2*c* facing downward to be in contact with the inner peripheral surface of the film 5.

The heater substrate 2*a* comprises, for example, aluminum substrate, an excellent heat conductor, which is 1 mm thick, 5 to 10 mm wide, and 240 mm long.

The resistance heating layer 2*b* is a 10 μm thick and 1 to 3 mm wide coated layer of resistive material such as Ag/Pd (silver/palladium), Ta2N, or the like, which is formed by screen printing or the like.

As for the heater 2, as voltage is applied (power is supplied) between the longitudinal ends of the electrically resistive layer 2*b*, the resistive layer 2*b* generates heat, heating in turn the substrate 2*a*, whereby the temperature of the entire heater, having the low thermal capacity, quickly rises with excellent start-up performance.

As to the temperature control of the heater 2, the output from the thermistor 2*d* of the heater 2 is A/D converter to be read by a CPU 7, and based on this data, the AC voltage applied to the resistive layer 2*b* of the heater 2 is subjected by TRIAC 8 to pulse width modulation, such as phase control, frequency control, or the like, to control the electric power supplied to the heater 2. Reference numeral 9 designates an AC power source.

Then, as the electric power is suppled to the heater 2, and the film 5 is rotatively driven by the rotation of the pressure roller 6, the recording material P as the material to be heated is conveyed from an unshown image forming section, being guided by feeder guide 10, and then, is fed between the film 5 and pressure roller 6, with the toner image facing upward, to be passed through a fixing nip (heating nip) N formed by the mutually pressing heater 2 and pressure roller 6, together with the rotating film, while being tightly in contact with the surface of this rotating film.

While the recording material P is passing through the fixing nip N, the unfixed toner image Ta on the recording material P is thermally fixed by the heat coming from the heater 2 through the film 5, emerging as the thermally fixed image of Tb.

The recording material P gradually peels away from the surface of the rotating film 5, due to the curvature of the film, after it passes through the fixing nip N, and then, the fixed recording material P is discharged, being guided by a discharge guide 11.

Next, the current control of this embodiment is described.

Figure 2:
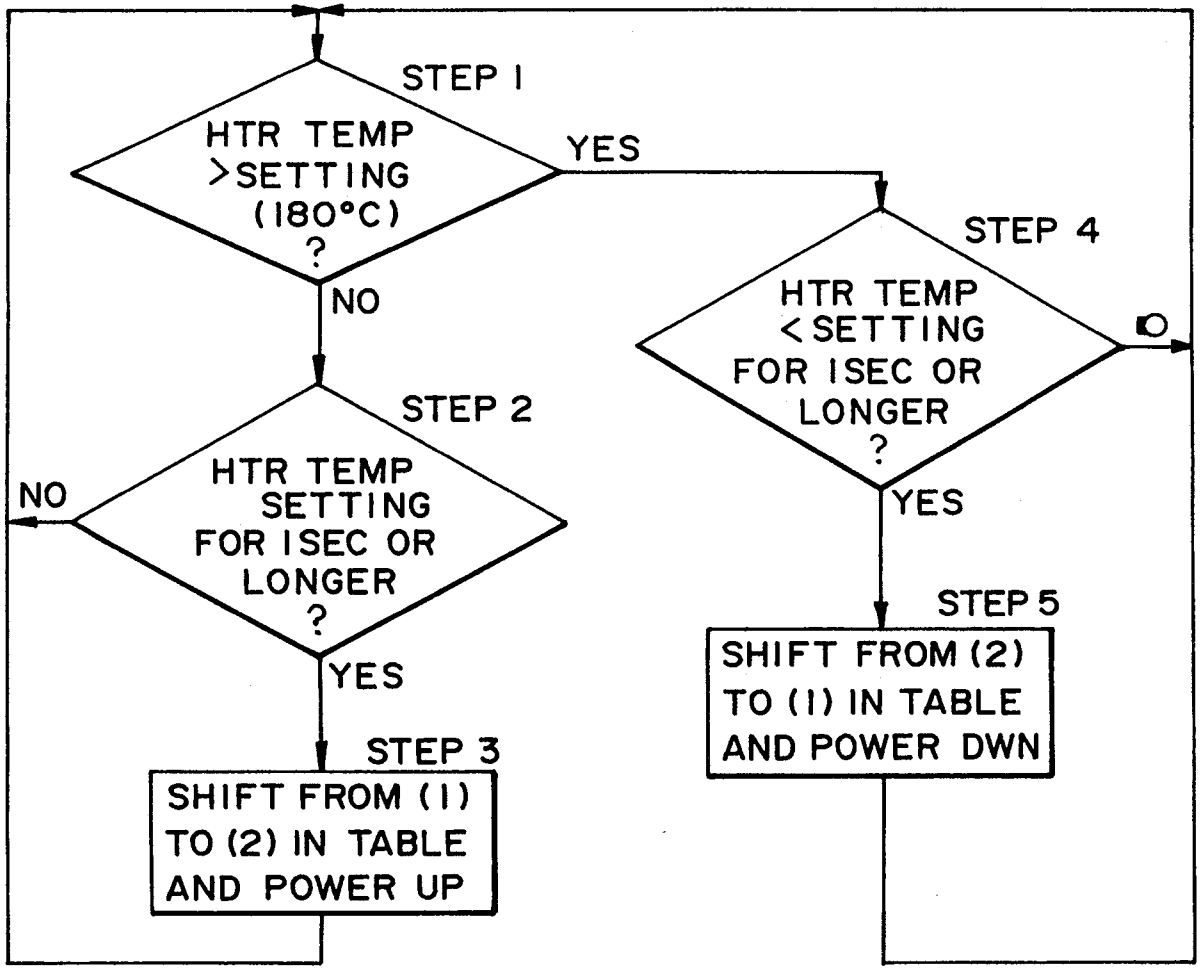
FIG. 2 is a control algorithm for the first embodiment.

FIG. 2 is a current control flowchart. Table 2 is a temperature-electric power table. The electric power output value in the table refers to the reference electric power, and the fraction refers to the duty ratio, the power application ratio.

TABLE 2

| Temperature - Power | | | |
|---|---|---|---|
| Heater temp. (°C.) | Power (1) | Power (2) | Power (3) |
| 190– | 0 0/10 | 0 0/10 | 0 0/10 |
| 180–190 | 400 8/10 | 350 7/10 | 300 6/10 |
| 170–180 | 450 9/10 | 400 8/10 | 350 7/10 |
| –170 | 500 10/10 | 500 10/10 | 500 10/10 |
| Heater temp. (°C.) | Power (4) | Power (5) | Power (6) |
| 190– | 0 0/10 | 0 0/10 | 0 0/10 |
| 180–190 | 250 5/10 | 200 4/10 | 150 3/10 |
| 170–180 | 300 6/10 | 250 5/10 | 200 4/10 |
| –170 | 300 10/10 | 250 10/10 | 200 10/10 |
| Heater temp. (°C.) | Power (7) | | |
| 190– | 0 0/10 | | |

TABLE 2-continued

| Temperature - Power | |
|---|---|
| 180–190 | 100 2/10 |
| 170–180 | 150 3/10 |
| –170 | 150 10/10 |

The electric power output value in the temperature-electric power table gradually reduces from (1) toward (7).

According to the algorithm in FIG. 2, if the temperature of the heater 2 detected by the thermistor is no more than the target value of 180° C. for the predetermined period of time such as no less than one second, and if, at this point in time, control is being executed based on table (2), the output electric power is increased by making leftward shift by one table to table (1); if it is based on table (3), by making shift to table (2); and so on. On the contrary, if the temperature of the heater 2 is no less than 180° C. for no less than one second, control is executed to reduce the output electric power by making a rightward shift by one table, from table (1) to table (2), from table (2) to table (3), and so on.

Figure 3:
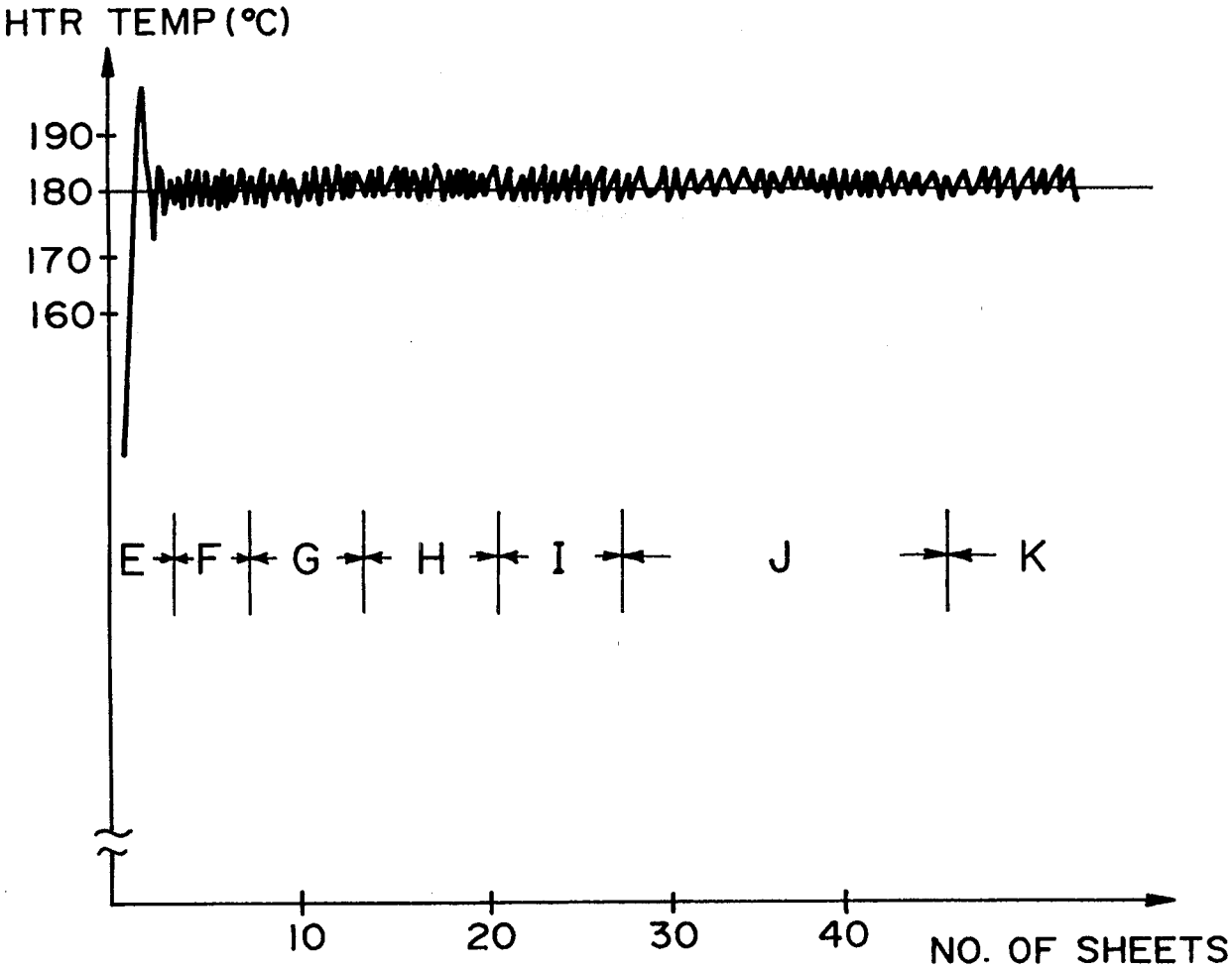
FIG. 3 is a temperature ripple chart for a heater controlled using the algorithm shown in FIG. 2.

The results of the temperature control is shown in FIG. 3, in which the fixing apparatus shown in FIG. 1 is used along with the temperature-electric power table shown in Table 2 and the algorithm shown in FIG. 2.

In FIG. 3, the heater temperature is maintained substantially close to 180° C. The table for the control is shifted from the temperature-electric power table (1), to (2), (3), (4), (5), (6), and (7) as the period shifts from E to F, G, H, I, and K, respectively.

Figure 4:
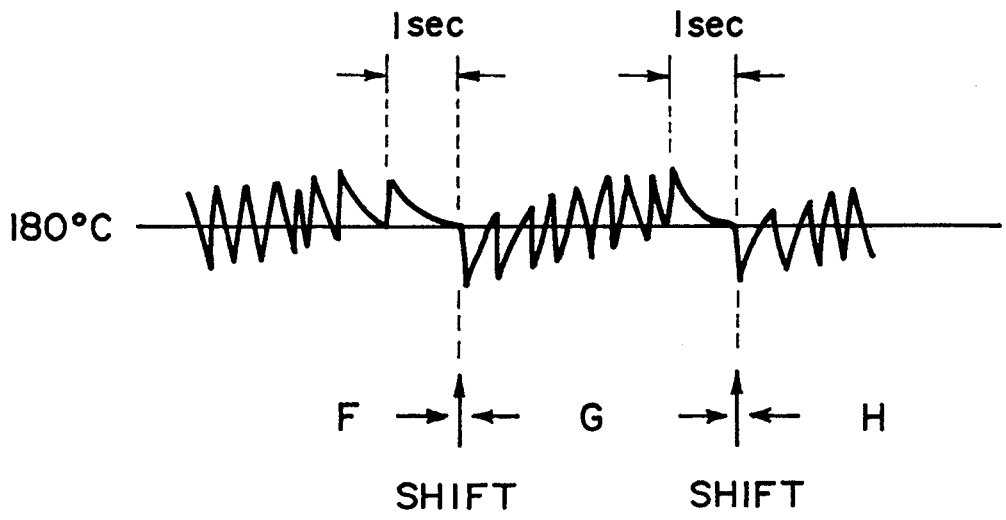
FIG. 4 is a partially enlarged chart of FIG. 3.

FIG. 4 is a partially enlarged portion of FIG. 3, representing the graph falling within a temperature range close to 180° C. In the period F, the temperature is controlled according to the table (2). As the pressure roller 6 and stays 3, 4 warm up, the heater temperature gradually increases, and when the heater temperature remains to be no less than 180° C. for no less than one second, the table used for the control is switched from the table (2) to the table (3). With this switch, the electric power to be applied is reduced, dropping the heater temperature back again to the temperature of approximately 180° C. in the period G.

According to this embodiment, the electric power supplied to the heater can be automatically corrected to have a proper value even when the electric power supplied to the heater 2 is changed by the voltage fluctuation of the power source.

For example, if the power source voltage drops from 100 V to 80 V, the electric power supplied to the heater reduces below the reference electric power, with the result of the heater temperature starting to drop. However, if the heater temperature remains to be less than 180° C. for no less than one second, the choice of the temperature-electric power table is automatically switched to increase the electric power supplied to the heater. Further, if the electric power source voltage increases, the electric power supplied to the heater is automatically reduced to maintain stably the heater temperature.

In other words, it becomes unnecessary to employ the electric power source voltage detecting means since it becomes possible to supply constantly a proper amount of electric power to the heater without reference to the electric power source voltage.

In this embodiment, the temperature-electric power table is switched if the heater temperature remains to be no less than 180° C., or no more than 180° C., for no less than one second. However, the switching may be made with reference to, for example, the duration of the temperature no less than 183° C., or no more than 177° C., for no less than one second.

In addition, the duration of the detection time, which is one second in this embodiment, may be selected to be one micro second, or one minute, depending on the choice of apparatus.

Further, in place of the heater temperature at a point in time, an average temperature for a predetermined period of time may be used as the heater temperature data.

Figure 5:
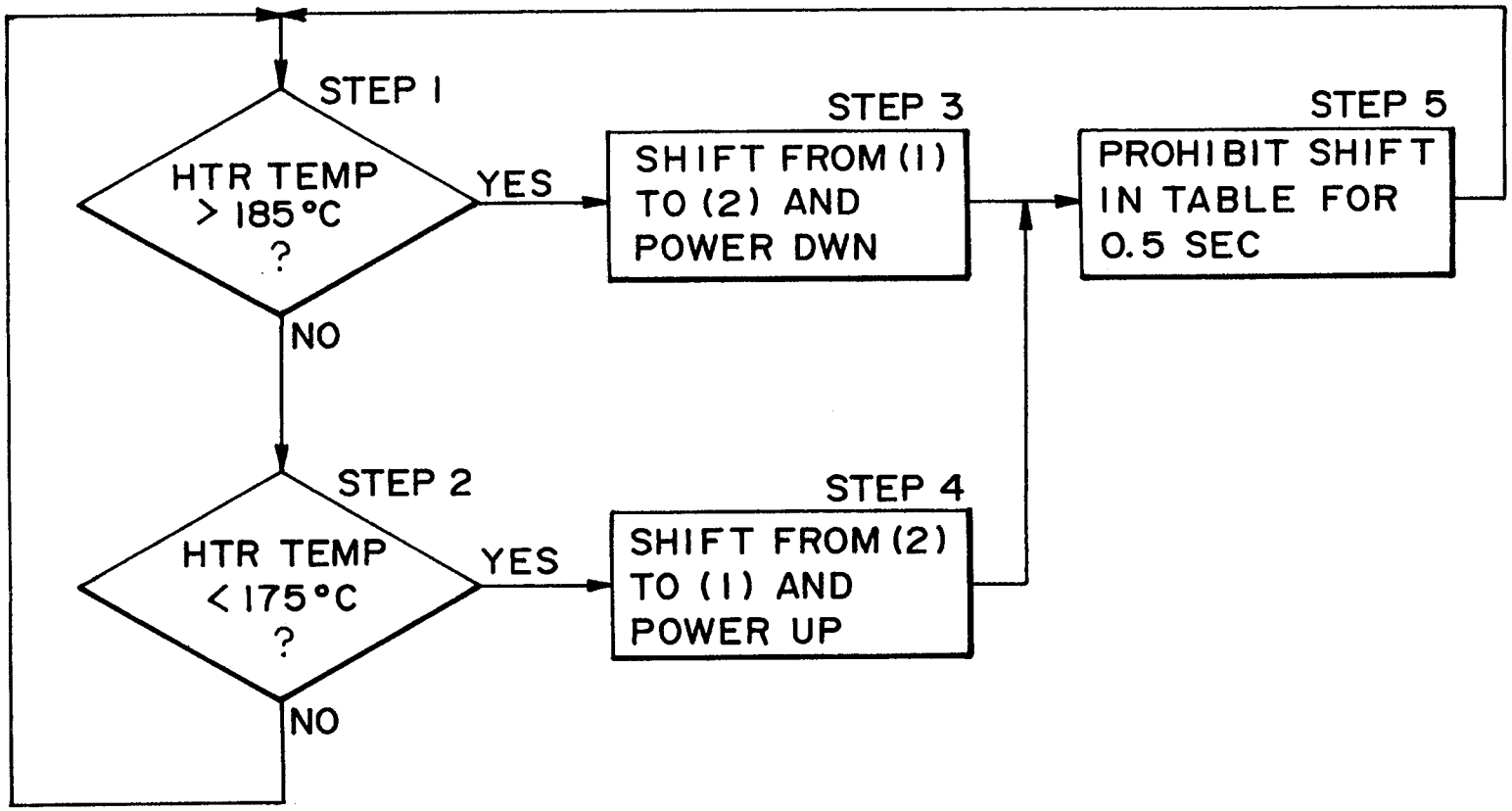
FIG. 5 is a control algorithm for the second embodiment.
Figure 7:
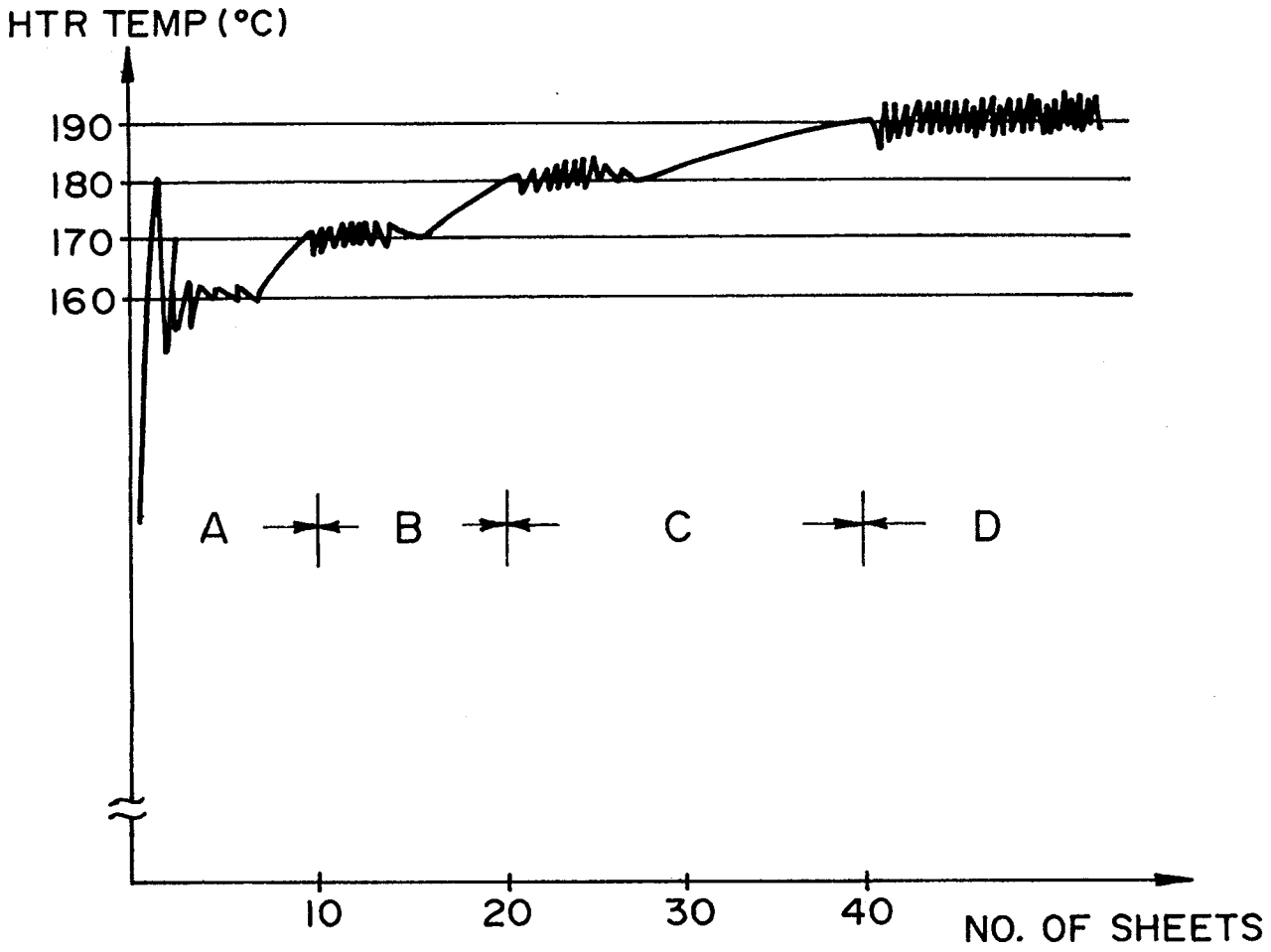
FIGS. 7, 8 are charts showing the temperature ripple of the heater.
Figure 8:
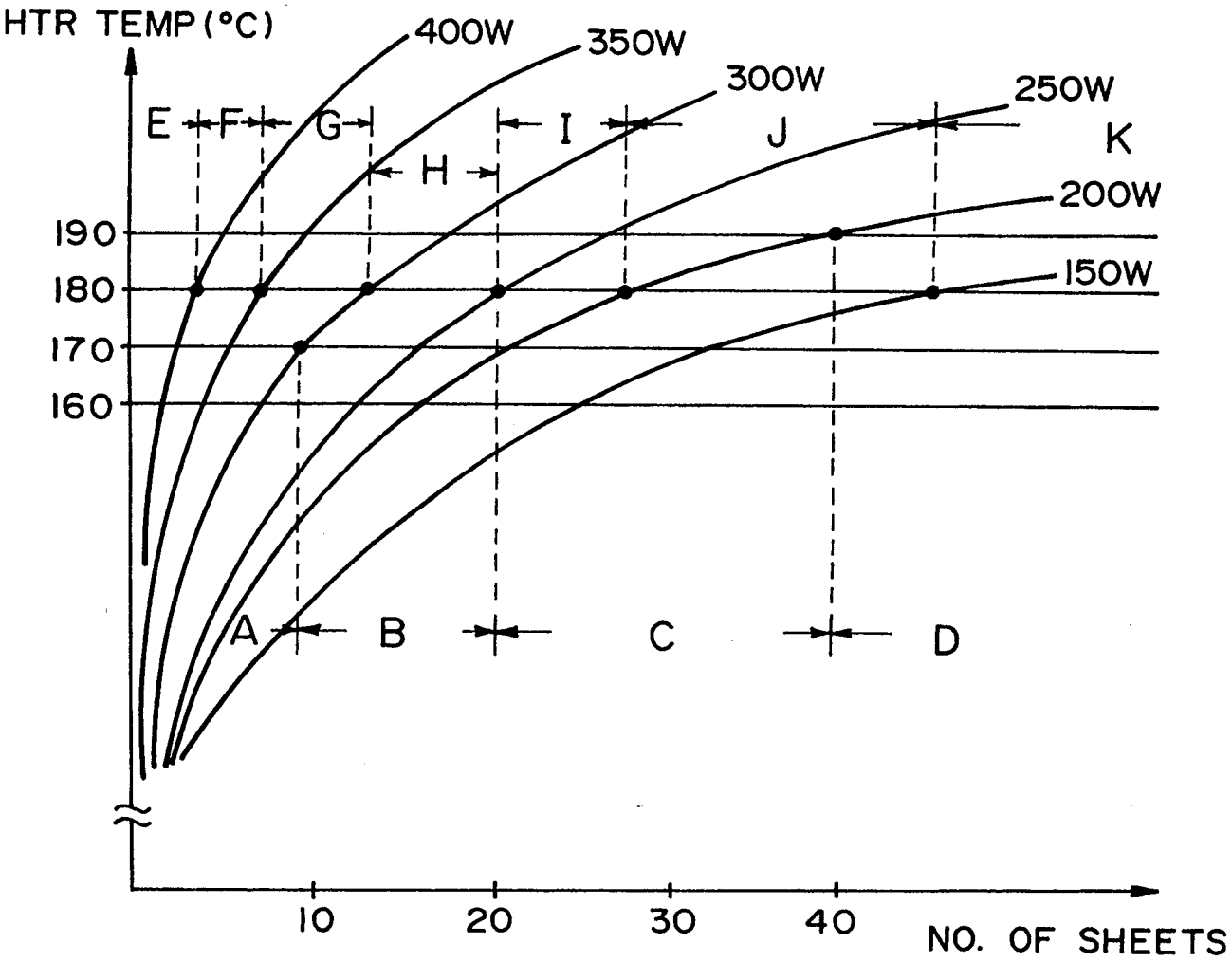

FIG. 5 shows another embodiment of the present invention.

In this embodiment, if the heater temperature exceeds 185° C., the selection of a table from the temperature-electric power tables given in Table 2 is shifted rightward by one table from the table (1) to the table (2), for example, to reduce the output electric power. On the contrary, if the heater temperature drops below 175° C., the shift is made leftward, for example, from the temperature-electric power table (2) to the table (1), to increase the output electric power.

In this case, switching of the temperature-electric power table is prohibited for a period of 0.5 second immediately after a switching is made, till the heater temperature responds to the preceding switch.

Figure 6:
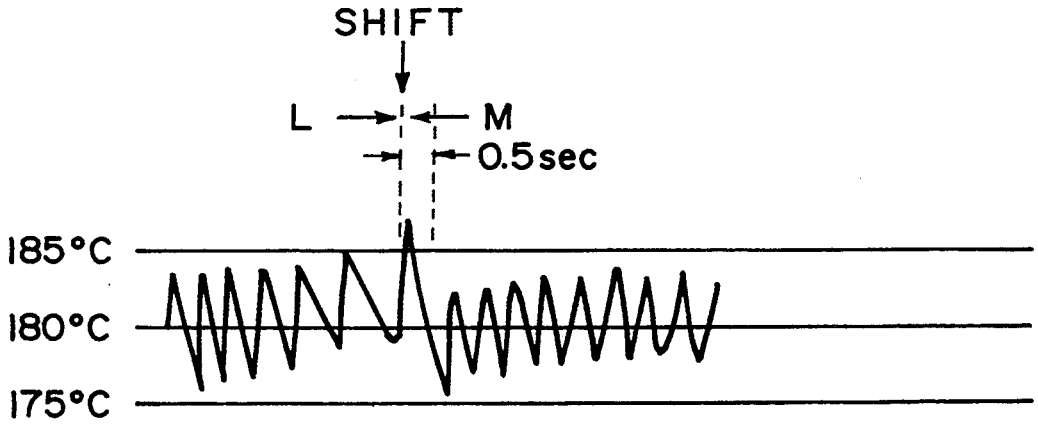
FIG. 6 is a temperature ripple chart for a heater controlled using the algorithm shown in FIG. 5.

The heater temperature fluctuation is shown in FIG. 6, which is caused when the temperature of the fixing apparatus shown in FIG. 1 is controlled using this algorithm.

The heater temperature exceeds 185° C. in the period between the periods L and M, and the temperature-electric power table is switched to reduce the electric power. The switching of the temperature-electric power table is prohibited for a period of 0.5 second immediately after a switching is made.

If this set up is not made, the temperature-electric power table is instantly switched to the table (1) which supplies the largest electric power.

The temperature-electric power table switching algorithm may always be in operative state, or the table switching operation may be prohibited during the period of pre-rotation, period between the sheets, and period of post-rotation, in which the paper P is not present in the fixing nip N. In the latter case, it is possible to prevent the temporary heater temperature drop which occurs, immediately after the paper P enters the fixing nip N, due to the low output electric power supply because of the smaller thermal load during the paper absent period.

The image heating apparatus in accordance with the present invention can be also used as an apparatus for improving the surface properties such as gloss by heating the recording material which carries the image, an apparatus for temporary fixing, and the like.

While the invention has been described with reference to the embodiments of the present invention, it is not confined to the details set forth and this application is intended to cover such modifications or changes as may come within the purposes of the improvements or the scope of the following claims.

What is claimed is:

1. An image heating apparatus comprising:

a heater;

a temperature detecting member for detecting a temperature of said heater;

controlling means for controlling electric power supplied to said heater so that the temperature detected by said temperature detecting member is maintained at a predetermined temperature; and comparing means for comparing the temperature detected by said temperature detecting member to a reference temperature higher than the predetermined temperature;

wherein when said detected temperature exceeds said reference temperature, said control means reduces a duty ratio of the electric power to be supplied to said heater; and after a predetermined period of time, when said detected temperature still exceeds the reference temperature, said control means further reduces the duty ratio of the electric power to be supplied to said heater.

2. An image heating apparatus according to claim 1 further comprising a film sliding on said heater, wherein said heater is used in static condition, and an image on the recording material is heated by heat from said heater through said film.

3. An image heating apparatus according to claim 2 further comprising a backup member forming a nip with said heater, with said film being interposed in the nip.

4. An image heating apparatus comprising:

a heater;

a temperature detecting member for detecting the temperature of said heater;

controlling means for controlling the electric power supplied to said heater so that the temperature detected by said temperature detecting member is maintained at a predetermined temperature;

comparing means for comparing the temperature detected by said temperature detecting member to a reference temperature lower than the predetermined temperature;

wherein when said detected temperature drops below said reference temperature, said controlling means increases a duty ratio of the electric power to be supplied to said heater; and after a predetermined period of time, when said detected temperature still remains below the reference temperature, said controlling means further increases the duty ratio of the electric power to be supplied to said heater.

5. An image heating apparatus according to claim 4 further comprising a film sliding on said heater, wherein said heater is used in static condition, and an image on the recording material is heated by heat from said heater through said film.

6. An image heating apparatus according to claim 5 further comprising a backup member forming a nip with said heater, with said film being interposed in the nip.

7. An image heating apparatus comprising:

a heater;

a temperature detecting means for detecting a temperature of said heater;

control means for controlling electric power supply to said heater so as to maintain detection of a predetermined temperature by said temperature detecting means during an image heating operation;

a plurality of tables for use by said control means to provide electric power supply levels for a plurality of temperature ranges;

comparison means for comparing the temperature detected by said temperature detecting means with a reference temperature;

wherein said control means changes the table to be used by said control means when the temperature detected by said temperature detecting means is higher than the reference temperature for a predetermined time period.

8. An apparatus according to claim 7, wherein said control means changes the table so that the electric power supply is reduced when the temperature detected by said temperature detecting means is higher than the reference temperature for a predetermined time period.

9. An image heating apparatus according to claim 7, wherein said reference temperature is the same as said predetermined temperature.

10. An image heating apparatus according to claim 7, further comprising a film sliding on said heater, wherein said heater is used in static condition, and an image on the recording material is heated by heat from said heater through said film.

11. An image heating apparatus according to claim 10, further comprising a backup member forming a nip with said heater, with said film being interposed in the nip.

12. An image heating apparatus comprising:

a heater;

a temperature detecting means for detecting a temperature of said heater;

control means for controlling electric power supply to said heater so as to maintain detection of a predetermined temperature by said temperature detecting means during an image heating operation;

a plurality of tables for use by said control means to provide electric power supply levels for a plurality of temperature ranges;

comparison means for comparing the temperature detected by said temperature detecting means with a reference temperature;

wherein said control means changes the table to be used by said control means when the temperature detected by said temperature detecting means is lower than the reference temperature for a predetermined time period.

13. An apparatus according to claim 12, wherein said control means changes the table so that the electric power supply is increased when the temperature detected by said temperature detecting means is lower than the reference temperature for a predetermined time period.

14. An image heating apparatus according to claim 12, wherein said reference temperature is the same as said predetermined temperature.

15. An image heating apparatus according to claim 12, further comprising a film sliding on said heater, wherein said heater is used in static condition, and an image on the recording material is heated by heat from said heater through said film.

16. An image heating apparatus according to claim 15, further comprising a backup member forming a nip with said heater, with said film being interposed in the nip.

* * * * *